US007992530B2

(12) United States Patent
Lee

(10) Patent No.: US 7,992,530 B2
(45) Date of Patent: Aug. 9, 2011

(54) CONTINUOUS VARIABLE VALVE LIFT DEVICE

(75) Inventor: Eun Ho Lee, Hwaseong-si (KR)

(73) Assignee: Hyundai Motor Company, Seoul (KR)

( * ) Notice: Subject to any disclaimer, the term of this patent is extended or adjusted under 35 U.S.C. 154(b) by 463 days.

(21) Appl. No.: 12/193,408

(22) Filed: Aug. 18, 2008

(65) Prior Publication Data

US 2009/0277405 A1 Nov. 12, 2009

(30) Foreign Application Priority Data

May 8, 2008 (KR) ..... 10-2008-0042921

(51) Int. Cl.
*F01L 1/34* (2006.01)

(52) U.S. Cl. ..... 123/90.16; 123/90.39; 123/90.44; 74/569

(58) Field of Classification Search ..... 123/90.16, 123/90.27, 90.31, 90.39, 90.44; 74/559, 74/567, 569
See application file for complete search history.

(56) References Cited

U.S. PATENT DOCUMENTS 6,886,512 B2 * 5/2005 Naumann ..... 123/90.39

* cited by examiner

*Primary Examiner* — Ching Chang
(74) *Attorney, Agent, or Firm* — Morgan, Lewis & Bockius LLP

(57) ABSTRACT

A continuous variable valve lift (CVVL) device opens and closes a valve by pressing a rocker arm through a rotational force transmitted from a drive cam. The CVVL device includes a drive arm, which is pivotably mounted such that one side thereof presses a rocker arm, a variable arm, which is pivotably mounted, and pushes and pivots the drive arm when pivoted, and a transmission arm, which is coupled with a transmission roller, which is located between the drive cam and the variable arm, at one end thereof, and is pivoted such that a position where the transmission roller comes into contact with both the drive cam and the variable arm is changed.

17 Claims, 6 Drawing Sheets

CONTINUOUS VARIABLE VALVE LIFT DEVICE

CROSS-REFERENCE TO RELATED APPLICATION

This application claims the benefit of Korean Patent Application No. 10-2008-0042921 filed on May 8, 2008, in the Korean Intellectual Property Office, the disclosure of which is incorporated herein by reference.

BACKGROUND OF THE INVENTION

1. Field of the Invention

The present invention relates to a continuous variable valve lift (CVVL) device and, more particularly, to a CVVL device in which a valve has simultaneously variable lift time and distance depending on the low-/high-speed operating range of an engine.

2. Description of the Related Art

As for an engine, a camshaft is rotated by a rotating force transmitted from a crank shaft, and an intake valve and an exhaust valve are reciprocated up and down with regular timing by cams of the camshaft. Thereby, intake air is supplied to a combustion chamber, and then combustion gas is exhausted. In this process, a fuel-air mixture is compressed and exploded to generate power.

At this time, a device that can continuously vary the lift distance of a valve according to an operating speed of the engine is called a continuous variable valve lift (CVVL) device.

Hereinafter, a conventional CVVL device will be described in detail with reference to the attached drawings.

FIG. 1 is a schematic view illustrating the configuration of a conventional continuous variable valve lift (CVVL) device.

The conventional CVVL device illustrated in FIG. 1 is disclosed in Japanese Patent Application Publication No. 2007-218242. This CVVL device includes a drive cam 4 installed on a cam shaft 2, a rocker arm 12 rocking in contact with the drive cam 4, a driving arm 19 driving a valve 5 in cooperation with the rocking arm 12, a variable arm 13 rotating the driving arm 19 around a rocking shaft of the rocking arm 12, an actuator driving the variable arm 13, and a cam module installed between the rocker arm 12 and the driver arm 19.

The rocking arm 12 and the variable arm 13 are relatively rotatably supported on a common control shaft 10. The driving arm 19 is connected to the variable arm 13 at a base end thereof, and is provided with a driving part 20 driving a rocker arm 6 at a leading end thereof. Further, the cam module includes cam faces 15*a* and 15*b* formed on the rocking arm 12, a cam follower 22 supported at a middle part of the driving arm 19. An initial position of the driving arm 19 is configured to be changed with respect to the rocking arm 12 by the rotation of the driving arm 19.

In the conventional CVVL device configured as described above, when the drive cam 4 is rotated in a counterclockwise direction in the state illustrated in FIG. 1, an end of the rocking arm 12 (right-hand end in FIG. 1) is rotated so as to approach the driving arm 19. After the end of the rocking arm 12 is contacted with the driving arm 19, the rocker arm 6 is pressed together, and thus the valve 5 is opened.

At this time, when the variable arm 13 is rotated in a counterclockwise direction in the state illustrated in FIG. 1, the driving arm 19 comes into contact with the rocker arm 6 at a middle portion compared to the state illustrated in FIG. 1, and thus comes closer to the end of the rocking arm 12. In this state, when the drive cam 4 is rotated, the end of the rocking arm 12 presses the driving arm 19 earlier than usual. Thus, the valve 5 is not only opened at an earlier point of time but also has a longer lift distance.

Thus, the conventional CVVL device illustrated in FIG. 1 makes it possible to control the lift time and distance of the valve according to the speed of the engine.

However, the conventional CVVL device configured as described above is configured to control the lift distance of the valve 5 by rotating the part, i.e. the driving arm 19, pressing the rocker arm 6. Thus, an outer surface of the driving arm 19 must be precisely machined so as to prevent the valve 5 from being lift when only the driving arm 19 is rotated. As a result, it is difficult to machine the driving arm 19.

Further, in the conventional CVVL device configured as described above, the opening time of the valve 5 becomes fast when the lift distance of the valve 5 becomes long, and the opening time of the valve 5 becomes late when the lift distance of the valve 5 becomes short. For this reason, the opening time of the valve 5 cannot be made constant regardless of the lift distance of the valve 5.

The information disclosed in this Background of the Invention section is only for enhancement of understanding of the background of the invention and should not be taken as an acknowledgement or any form of suggestion that this information forms the prior art that is already known to a person skilled in the art.

SUMMARY OF THE INVENTION

Embodiments of the present invention provides a continuous variable valve lift (CVVL) device, which does not need to machine an outer surface of the drive arm pressing the rocker arm so as to have a specific profile, thereby simplifying the shape of the drive arm and constantly controlling a lift time of the valve regardless of a lift distance of the valve.

There is provided a continuous variable valve lift device, which opens and closes a valve by pressing a rocker arm through a rotational force transmitted from a drive cam.

In an exemplary embodiment of the present invention, the continuous variable valve lift may include a drive arm wherein one end portion thereof pivotally presses the rocker arm; a variable arm pivotably mounted substantially to the other end of the drive arm, and pushing a portion of the drive arm in a pivoting direction when the variable arm is pivoted; and a transmission arm wherein one end thereof is coupled with a transmission roller and the one end of the transmission arm is located between the drive cam and the variable arm and is pivoted such that positions where the transmission roller comes into contact with both the drive cam and the variable arm are changed. The one end portion of the drive arm may be shaped of a linear bar. The continuous variable valve lift device may further comprise a rotary arm, which is rotatably coupled to a driving shaft of the drive cam, is pivotably coupled with the other side of the transmission arm, and pivots the transmission arm when the rotary arm is rotated with respect to the driving shaft. The drive arm and the variable arm may be pivoted around a pivoting shaft. The other end of the drive arm may be supported by a support roller. The support roller may be constrained by a support block.

In another exemplary embodiment of the present invention, the variable arm may include a variable roller positioned at a contact portion of the variable arm with the drive arm; and the drive arm includes a rolling face on which the variable roller of the variable arm is slidably rolled. The rolling face may comprise: a lift section where the drive arm is pivoted when the variable roller is contacted; and a zero lift section where the drive arm is not pivoted when the variable roller is contacted. The variable arm may be pivoted and the variable roller may be rolled within the zero lift section of the rolling face when a contact position of the variable arm with the transmission roller is changed in a state where the rotational force of the drive cam is not applied. The contact position of the variable arm with the transmission roller may be changed by an elastic member applying an elastic force to the variable arm.

According to exemplary embodiment of the present invention, the continuous variable valve lift device does not need to machine an outer surface of the drive arm pressing the rocker arm so as to have a specific profile, so that it can simplify the shape of the drive arm and constantly control a lift time of the valve regardless of a lift distance of the valve.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE EXEMPLARY EMBODIMENT

The present invention will now be described more fully hereinafter with reference to the accompanying drawings, in which exemplary embodiments thereof are shown. In the following description of the present invention, a detailed description of known functions and components incorporated herein will be omitted when it may make the subject matter of the present invention rather unclear.

Figure 1:
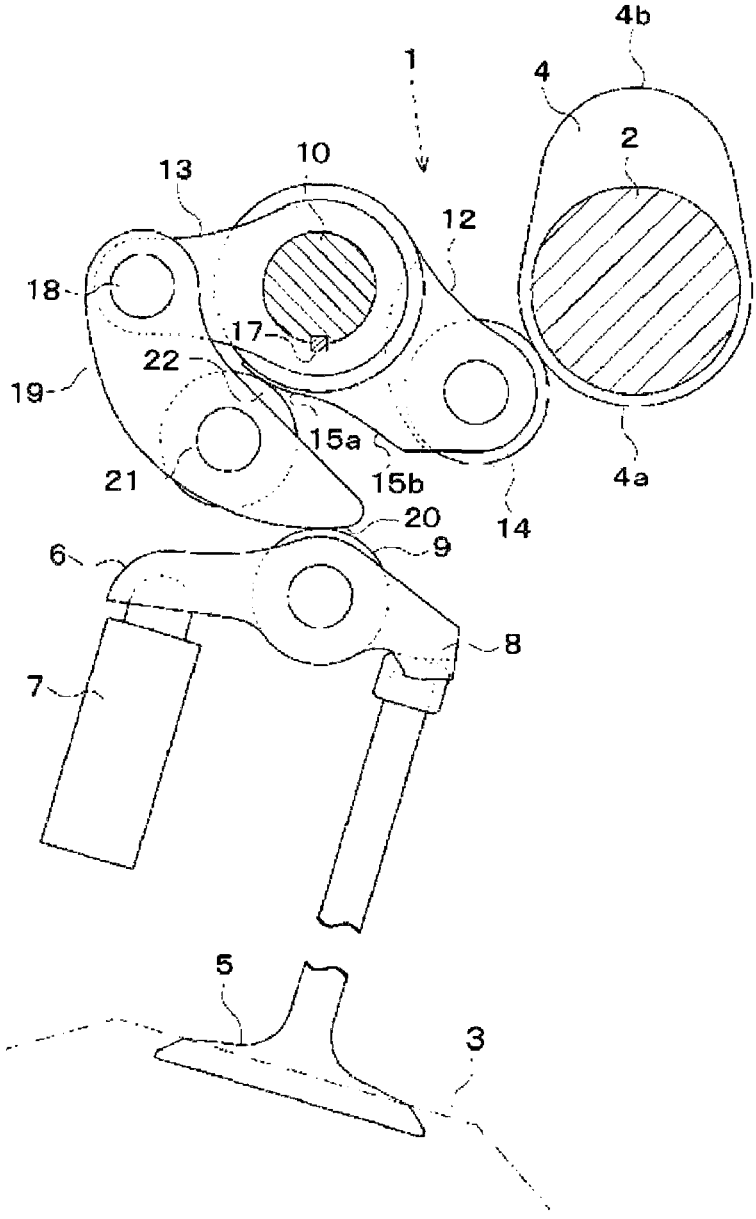
PRIOR ART Fig.1
FIG. 1 is a schematic view illustrating the configuration of a conventional continuous variable valve lift (CVVL) device.
Figure 2:
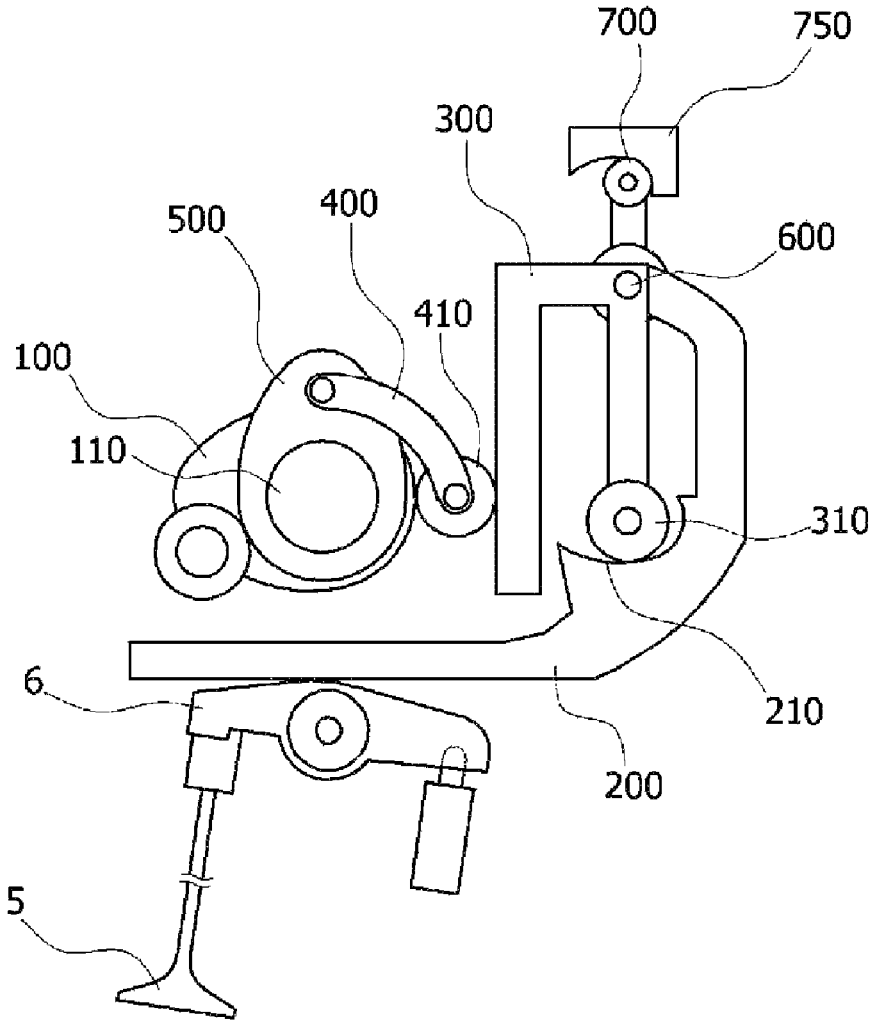
FIG. 2 is a schematic view illustrating the configuration of a CVVL device according to an exemplary embodiment of the present invention.
Figure 3:
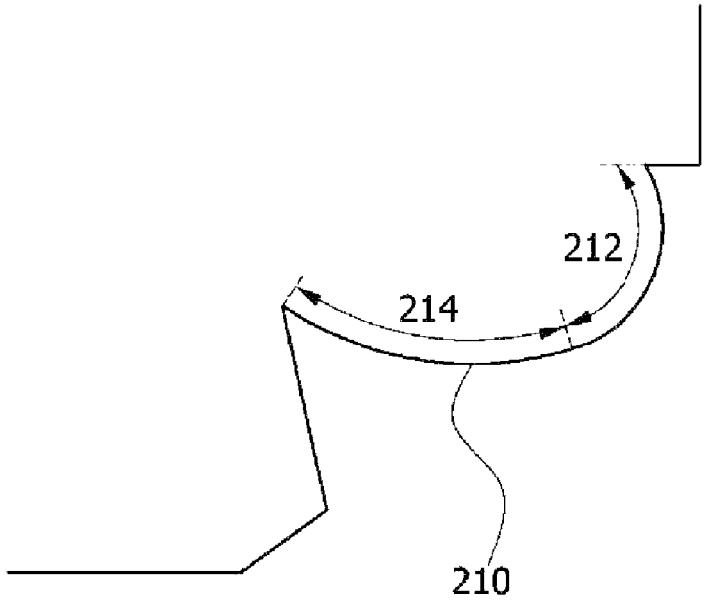
FIG. 3 is an enlarged view illustrating a rolling face included in a CVVL device according to an exemplary embodiment of the present invention.

FIG. 2 is a schematic view illustrating the configuration of a continuous variable valve lift (CVVL) device according to an exemplary embodiment of the present invention. FIG. 3 is an enlarged view illustrating a rolling face of the drive arm included in a CVVL device according to an exemplary embodiment of the present invention.

The CVVL device of the present invention is characterized by, when a valve 5 is opened and closed by pressing a rocker arm 6 with the rotational force of a drive cam 100, controlling a lift distance of the valve 5 according to the operating speed of an engine, simplifying a drive arm 200 pressing the rocker arm 6 in a shape, for instance, of a linear bar, and constantly maintaining a lift time of the valve 5.

To this end, the CVVL device of the present invention includes a drive arm 200, which is pivotably mounted such that one end portion thereof presses downwards a rocker arm 6, a variable arm 300 pivotably mounted substantially onto the other end of the drive arm 200 and pushing a portion of the drive arm 200 and thus pivoting the drive arm 200 when the variable arm 300 is pivoted, and a drive cam 100 pushing a portion of the variable arm 300 and thus pivoting the variable arm 300.

The transmission arm 400 is coupled with a transmission roller 410, wherein one side of the transmission arm 400 is located between the drive cam 100 and the variable arm 300 so that the transmission roller 410 continue to be in contact with the drive cam 100 and the variable arm 300 and can move along a portion of the variable arm 300 in a longitudinal direction thereof. The drive cam 100 is connected to a driving shaft 110.

In this manner, the CCVL device of the present invention is configured so that the drive cam 100 pivots indirectly the rocker arm 6 via the transmission arm 400, the transmission roller 410, the variable arm 300, and the drive arm 200, rather than directly pivoting the drive arm 200. Thus, it is not necessary to offer a particular profile to part of an outer face of the drive arm 200, which comes into contact with the rocker arm 6. In other words, the drive arm 200 constituting the CVVL device can be simplified in the shape such as a linear bar as illustrated in FIG. 2, so that it can be easily produced.

Further, the variable arm 300 is equipped with a variable roller 310 at a portion where it comes into contact with the drive arm 200 in order to reduce contact friction against the drive arm 200, and the drive arm 200 has a rolling face 210 on which the variable roller 310 is rolled.

At this time, as illustrated in FIG. 3, the rolling face 210 of the drive arm 200 comprises a lift section 212 to make the drive arm 200 pivoted counterclockwise in the drawing when the variable roller 310 is contacted thereon, and a zero lift section 214 to make the drive arm 200 not pivoted when the variable roller 310 is contacted thereon. Thus, the drive arm 200 does not press the rocker arm 6 while the transmission roller 410 is positioned within the zero lift section 214, but it presses downwards the rocker arm 6 while the transmission roller 410 is positioned within the lift section 212.

Further, the transmission arm 400 may be independently pivoted, or be pivoted by a separate driving means. To this end, as an exemplary embodiment, the CVVL device of the present invention further includes a rotary arm 500, which is rotatably coupled to the driving shaft 110 of the drive cam 100, is pivotably coupled to the other side of the transmission arm 400, and thus pivots the transmission arm 400 when the rotary arm 500 is rotated.

In this manner, when the transmission arm 400 is configured to be pivoted by the rotary arm 500, the configuration of pivoting the transmission arm 400 can be simplified, so that the entire CVVL device can be made compact.

Further, a portion of the other end of the drive arm 200 and one end of the variable arm 300 are pivotally coupled each other by a pivoting shaft 600 and are preferably configured to be pivoted around the pivoting shaft 600 for the purpose of structural simplification. In an exemplary embodiment of the present invention, the other end of the drive arm 200 is equipped with a separate support roller 700, which supports stable pivoting of the drive arm 200, at an upper end thereof (i.e. an end opposite the contacted rocker arm 6). The motion of the support roller 700 is constrained by a support block 750.

Figure 4:
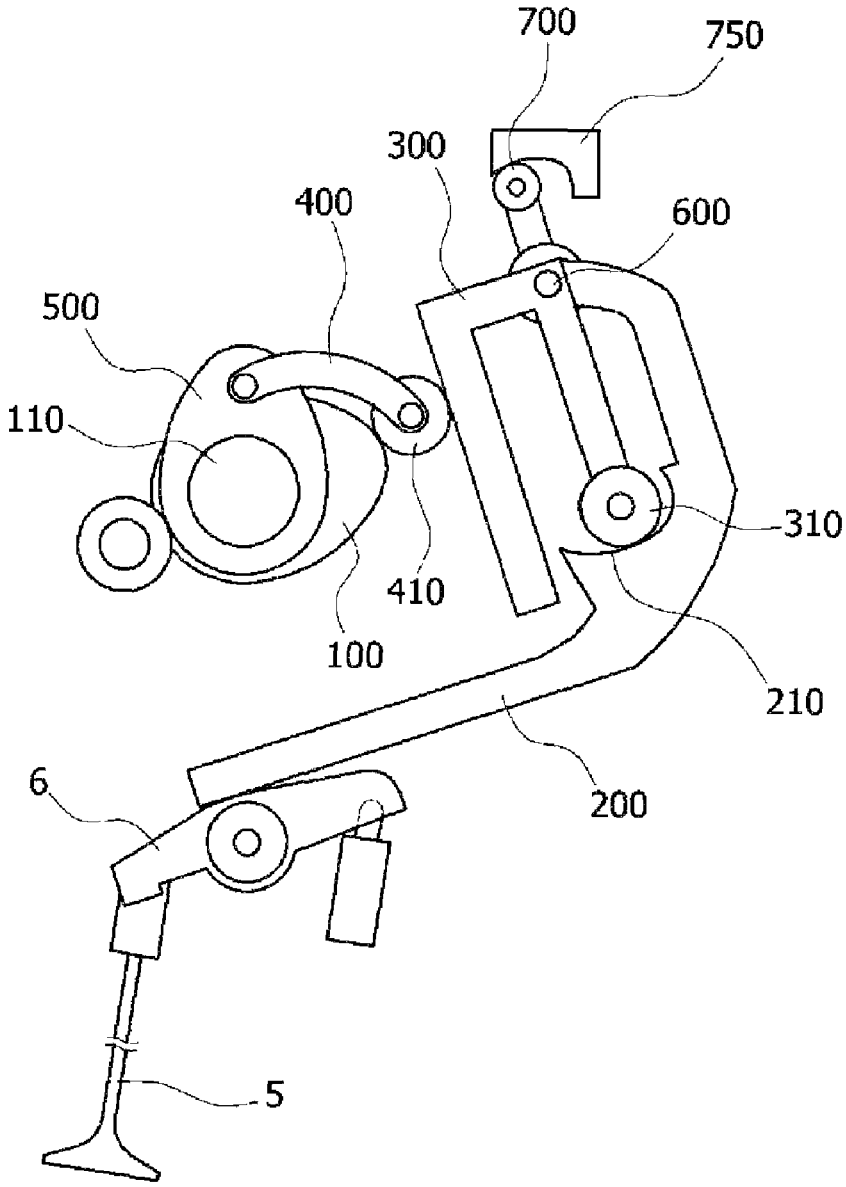
FIGS. 4 through 6 are schematic views illustrating the operation of a CVVL device according to an exemplary embodiment of the present invention.
Figure 5:
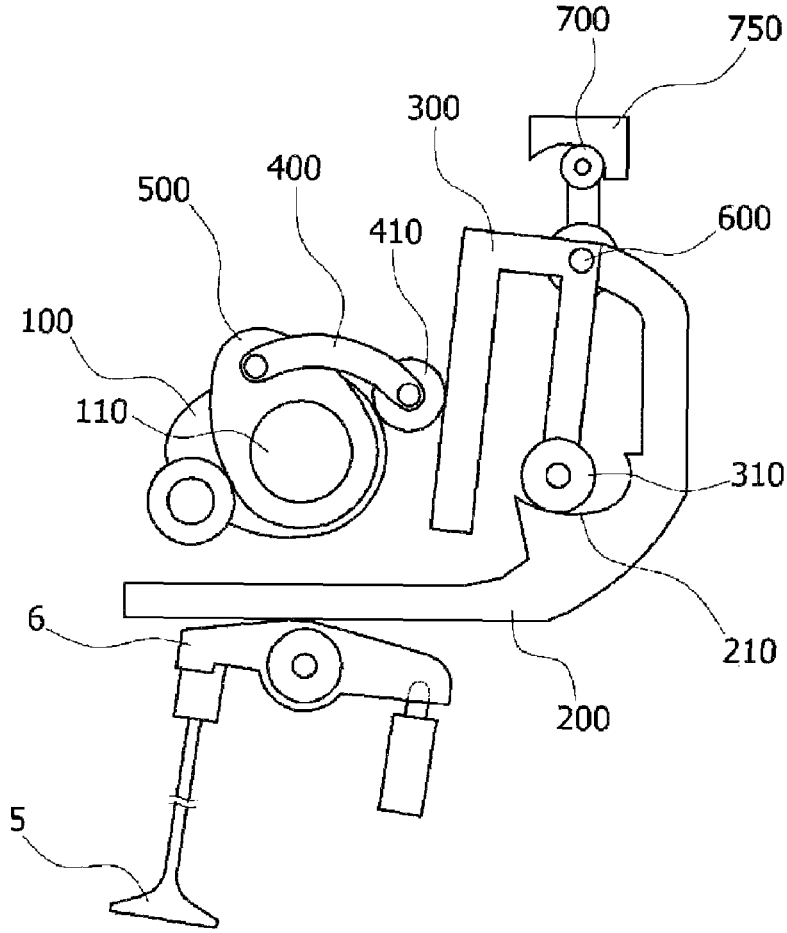
Figure 6:
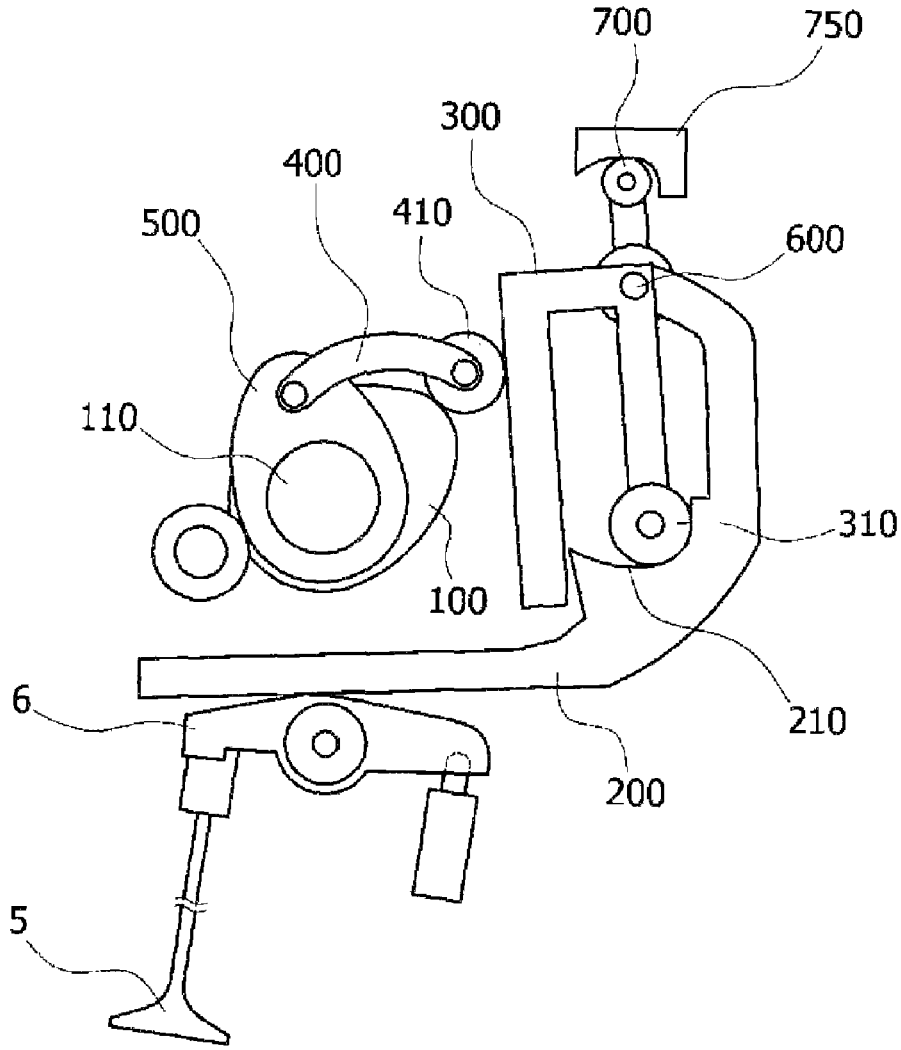

FIGS. 4-6 are schematic views illustrating the operation of a CVVL device according to an exemplary embodiment of the present invention.

When the drive cam 100 is rotated in the state of FIG. 2 counterclockwise, the drive cam 100 lifts and pushes the transmission roller 410. The transmission roller 410 rolls upwards over the variable arm 300 and thus pushes an upper portion of the variable arm 300 in a counterclockwise direction with respect to the pivoting shaft 600, and thus the variable roller 310 mounted on an end of the variable arm 300 is rolled along the rolling face 210 of the drive arm 200. At this time, the variable roller 310 is rolled within the lift section 212 of the rolling face 210, so that the variable arm 300 is pivoted with respect to the pivoting shaft 600 in a counterclockwise direction as well as illustrated in FIG. 4. The support roller 700 moves in the counterclockwise direction in the drawing along the support block 750 which is opened toward the variable arm 300.

When the drive arm 200 is pivoted in a counterclockwise direction with respect to the pivoting shaft 600 in this way, the rocker arm 6 is pressed downwards as illustrated in FIG. 4, so that the valve 5 is opened.

As shown in FIG. 5, when the rotary arm 500 is further rotated in a counterclockwise direction with respect to the driving shaft 110 in the state of FIG. 4 so that the major axis of the driving cam 100 passes the transmission roller 410, the transmission roller 410 pivotally moves downwards due to its self weight and rides on an outer circumference of the drive cam 100. At this time, the variable arm 300 is supplied with an elastic force, for instance, by a separate elastic member (not shown), in a direction in which the variable arm 300 comes into contact with the transmission roller 410. Thus, the variable arm 300 is rotated in a clockwise direction with respect to the pivoting shaft 600 so as to continue to be in contact with the transmission roller 410 as illustrated in FIG. 5, and the variable roller 310 becomes located on the left-hand side of the zero lift section 214.

In this state, if the drive cam 100 is further rotated counterclockwise, the transmission roller 410 is rolled upwards on the variable arm 300 and pushes the variable arm 300 in the counterclockwise direction with respect to the pivoting shaft 600 and the variable roller 310 moves on the rolling face 210 as illustrated in FIG. 6. The drive arm 200 is not pivoted while the transmission roller 410 is within the zero lift section 214, whereas the drive arm 200 is pivoted counterclockwise in the drawing while transmission roller 410 is within the lift section 212 past the zero lift section 214.

The drive arm 200 is not pivoted while the variable roller 310 moves from the left-hand end to the right-hand end of the zero lift section 214. Thus, a pivoting angle of the drive arm 200 is increased as an initial position of the variable roller 310 approaches the right-hand end of the zero lift section 214, and is decreased as an initial position of the variable roller 310 approaches the left-hand end of the zero lift section 214. Accordingly, the lift distance of the valve 5 when the drive cam 100 is pivoted in the state of FIG. 5 becomes shorter than that when the drive cam 100 is pivoted in the state of FIG. 2.

Further, the CVVL device of the present invention is configured so that the drive arm 200 pressing the rocker arm 6 is not directly pivoted by the drive cam 100, but it is indirectly pivoted via the transmission roller 410 and the variable arm 300 through the rotational force transmitted from the drive cam 100, so that the lift time of the valve 5 can be controlled.

For example, when only the drive cam 100 is pivoted in the state of FIG. 2, the valve 5 begins to be opened at a point of time at which the end of the major axis of the drive cam 100 comes into contact with the transmission roller 410. However, when only the drive cam 100 is pivoted in the state of FIG. 5, the valve 5 does not begin to be opened at a point of time at which the end of the major axis of the drive cam 100 comes into contact with the transmission roller 410, but the valve 5 begins to be opened after delay occurs for a time when the variable roller 310 goes through the zero lift section 214.

However, when the drive cam 100 is rotated in the state of FIG. 2, the transmission arm 400 is pivoted in a counterclockwise direction at a point of time at which the end of the major axis of the drive cam 100 comes into contact with the transmission roller 410, and thus the transmission roller 410 moves in an upward direction. Thereby, the lift time of the valve 5 is not delayed, but the lift distance of the valve can be reduced as illustrated in FIG. 6.

In other words, the application of the CVVL device of the present invention allows the lift distance as well as the lift time of the valve 5 to be freely controlled.

While the present invention has been described with reference to the particular illustrative embodiments and the accompanying drawings, it is not to be limited thereto. Accordingly, the foregoing embodiments can be suitably modified and altered, and such applications fall within the scope and spirit of the present invention that shall be defined by the appended claims.

What is claimed is:

1. A continuous variable valve lift device, which opens and closes a valve by pressing a rocker arm through a rotational force transmitted from a drive cam, comprising:

a drive arm wherein one end portion thereof pivotally presses the rocker arm;

a variable arm pivotably mounted substantially to the other end of the drive arm, and pushing a portion of the drive arm in a pivoting direction when the variable arm is pivoted; and a transmission arm wherein one end thereof is coupled with a transmission roller and the one end of the transmission arm is located between the drive cam and the variable arm and is pivoted such that positions where the transmission roller comes into contact with both the drive cam and the variable arm are changed.

2. The continuous variable valve lift device according to claim 1, wherein the one end portion of the drive arm is shaped of a linear bar.

3. The continuous variable valve lift device according to claim 1, wherein:

the variable arm includes a variable roller positioned at a contact portion of the variable arm with the drive arm; and the drive arm includes a rolling face on which the variable roller of the variable arm is slidably rolled, the rolling face comprising:

a lift section where the drive arm is pivoted when the variable roller is contacted; and a zero lift section where the drive arm is not pivoted when the variable roller is contacted.

4. The continuous variable valve lift device according to claim 3, wherein the variable arm is pivoted and the variable roller is rolled within the zero lift section of the rolling face when a contact position of the variable arm with the transmission roller is changed in a state where the rotational force of the drive cam is not applied.

5. The continuous variable valve lift device according to claim 4, wherein the contact position of the variable arm with the transmission roller is changed by an elastic member applying an elastic force to the variable arm.

6. The continuous variable valve lift device according to claim 4, further comprising a rotary arm, which is rotatably coupled to a driving shaft of the drive cam, is pivotably coupled with the other side of the transmission arm, and pivots the transmission arm when the rotary arm is rotated with respect to the driving shaft.

7. The continuous variable valve lift device according to claim 4, wherein the drive arm and the variable arm are pivoted around a pivoting shaft.

8. The continuous variable valve lift device according to claim 7, wherein the other end of the drive arm is supported by a support roller.

9. The continuous variable valve lift device according to claim 8, wherein the support roller is constrained by a support block.

10. The continuous variable valve lift device according to claim 3, further comprising a rotary arm, which is rotatably coupled to a driving shaft of the drive cam, is pivotably coupled with the other side of the transmission arm, and pivots the transmission arm when the rotary arm is rotated with respect to the driving shaft.

11. The continuous variable valve lift device according to claim 3, wherein the drive arm and the variable arm are pivoted around a pivoting shaft.

12. The continuous variable valve lift device according to claim 11, wherein the other end of the drive arm is supported by a support roller.

13. The continuous variable valve lift device according to claim 12, wherein the support roller is constrained by a support block.

14. The continuous variable valve lift device according to claim 1, further comprising a rotary arm, which is rotatably coupled to a driving shaft of the drive cam, is pivotably coupled with the other side of the transmission arm, and pivots the transmission arm when the rotary arm is rotated with respect to the driving shaft.

15. The continuous variable valve lift device according to claim 1, wherein the drive arm and the variable arm are pivoted around a pivoting shaft.

16. The continuous variable valve lift device according to claim 15, wherein the other end of the drive arm is supported by a support roller.

17. The continuous variable valve lift device according to claim 16, wherein the support roller is constrained by a support block.

* * * * *